US005487208A

United States Patent [19]

Hauner

[11] Patent Number: 5,487,208

[45] Date of Patent: Jan. 30, 1996

[54] DEVICE FOR THE DETECTION OF BREAKAGE OF TEXTILE FIBER SLIVERS BEFORE A DRAW FRAME

[75] Inventor: Friedrich Hauner, Ingolstadt, Germany

[73] Assignee: Rieter Ingolstadt Spinnereimaschinenbau AG, Ingolstadt, Germany

[21] Appl. No.: 164,348

[22] Filed: Dec. 9, 1993

[30] Foreign Application Priority Data

Dec. 23, 1992 [DE] Germany ..... 42 43 847.0

[51] Int. Cl.[6] ..... D01G 31/00

[52] U.S. Cl. ..... 19/0.25; 19/157

[58] Field of Search ..... 19/0.2, 0.21, 0.22, 19/0.25, 0.26, 239, 159 A, 0.24; 57/264, 265, 80, 81, 83, 86; 226/11, 24, 45

[56] References Cited

U.S. PATENT DOCUMENTS

| | | | |
|---|---|---|---|
| 3,330,007 | 7/1967 | Foster . | |
| 3,445,894 | 5/1969 | Rayfield et al. | 19/0.25 |
| 4,450,677 | 5/1984 | Von Ronai-Horvath | 14/0.25 |
| 4,922,704 | 5/1990 | Slavik et al. | 19/0.25 |

FOREIGN PATENT DOCUMENTS

| | | | |
|---|---|---|---|
| 383228 | 12/1964 | Czechoslovakia . | |
| 0367211 | 10/1989 | European Pat. Off. . | |
| 1172167 | 6/1964 | Germany | 19/0.21 |
| 886525 | 1/1962 | United Kingdom . | |
| 1281379 | 7/1972 | United Kingdom . | |

OTHER PUBLICATIONS

Rieter Spinning System Prospectus for RSB 851/SB851 Drawframe, Sep., 1991.

European Search Report With Translation.

*Primary Examiner*—C. D. Crowder
*Assistant Examiner*—Larry D. Worrell, Jr.
*Attorney, Agent, or Firm*—Dority & Manning

[57] ABSTRACT

A device is provided for the detection of breakage of textile fiber slivers before a draw frame of the textile industry. The device must detect breakage of presented fiber slivers. The invention improves the reliability of detection of sliver breakage of presented textile fiber slivers at very high sliver intake speeds of a draw frame. It is a characteristic of the invention that the monitoring device is provided with a deflection device for the fiber slivers which ensures that any broken fiber slivers are detected by the monitoring device.

20 Claims, 4 Drawing Sheets

DEVICE FOR THE DETECTION OF BREAKAGE OF TEXTILE FIBER SLIVERS BEFORE A DRAW FRAME

BACKGROUND OF THE INVENTION

The instant invention relates to a device for detection of breakage of textile fiber slivers before delivery to a draw frame. The device must detect the sliver breakage in presented fiber slivers near or within a feeding device for textile fiber slivers, i.e. before entry into the draw frame.

The fiber slivers are taken from cans and are conveyed via a feeding device to the roller pair on the intake table of the drafting rollers. The feeding device is located in a section before the intake table of drafting rollers. On both sides or on only one side of the feeding device, cans with the fiber sliver to be processed are placed. The fiber sliver of each can is pulled straight up from the can and is deflected by the feeding device by an angle of approximately 90° in the direction of the draw frame. The fiber slivers of all cans are conveyed parallel to each other by the feeding device, with the fiber slivers being conveyed at a higher level than the drafting rollers. The fiber slivers leave the feeding device by being conveyed to the draw frame away from the feeding device at a downward slope. During the transportation of the fiber slivers being presented to the draw frame, individual fiber slivers may break. The cause is usually a defect of the sliver stemming from the way it was deposited. For this reason a monitoring device is installed in the conveying path of the fiber sliver to detect and signal any sliver breakage. The signal for a sliver breakage causes the draw frame to stop so that the operating personnel can piece the band ends before they enter the draw frame. The monitoring device may be installed inside the feeding device or between the feeding device and the draw frame.

A sliver breakage of the running sliver is detected by letting the sliver end drop down from its conveying path after leaving the feeding device to be detected by the monitoring section of the monitoring device. The monitoring device operates in a known manner according to the optical light barrier principle. Such a known monitoring device between draw frame and feeding device is shown in the prospectus "Strecken", September 1991, page 11, of Rieter Spinning Systems.

With the high prevailing intake speeds of the fiber sliver the problem arises that not every sliver breakage is certain to be detected by the monitoring device. At high fiber sliver intake speeds, it occurs that the sliver end reaches a drop level at the level of the monitoring sections only after the monitoring device, so that the dropping sliver end was not able to trigger a signal. In such a case, the sliver end runs through the charging or contact rollers in the intake of the draw frame and is only there detected as a sliver breakage. This has the disadvantage that the sliver ends can no longer be pieced together, but a new sliver start must be threaded. This is much more time consuming than the piecing of sliver ends before entry into the draw frame.

OBJECTS AND SUMMARY OF THE INVENTION

It is a principal object of the instant invention to improve the reliability of detection of sliver breakage in presented textile fiber slivers at very high intake speeds of the fiber sliver into a draw frame. Additional objects and advantages of the invention will be set forth in part in the following description, or will be obvious from the description, or may be learned by practice of the invention.

The monitoring device for the detection of fiber sliver breakage can be located near the feeding device, i.e. on the side of the departing fiber slivers or within the feeding device.

It is a characteristic of the invention that the monitoring device is provided with a deflection device for the fiber slivers, so that the fiber sliver breakages may be detected with greater certainty. The deflection device is located near the monitoring device. i.e. in the conveying direction of the fiber slivers before or after the monitoring device. The deflection device is in a horizontal plane above the horizontal plane of the monitoring device, so that unbroken fiber slivers pass the monitoring device above its monitoring section. The monitoring section functions without contact with the fiber sliver end to be detected. The monitoring section is interrupted if a fiber sliver end passes it transversely. This interruption produces a signal in the corresponding signal process, and this signal is used to stop the machine.

It is a further characteristic that the deflection device deflects the fiber slivers by pressing against them in the conveying path, so that each sliver is imparted tension. The produced tension is such that no defective drafting occurs. The tension is nevertheless sufficiently strong so that the tension produced when a breakage occurs is sure to fling the fiber sliver end into the monitoring section of the monitoring device in spite of the high sliver intake speed and the relatively low fiber sliver weight. The deflection device may be a solid bar or a tubular bar made of a low-friction material. The bar is at a right angle to the running direction of all fiber slivers. This has the advantage that the reliability of detection of a sliver breakage is increased with little technical outlay.

DETAILED DESCRIPTION OF THE PREFERRED EMBODIMENTS

Figure 1:
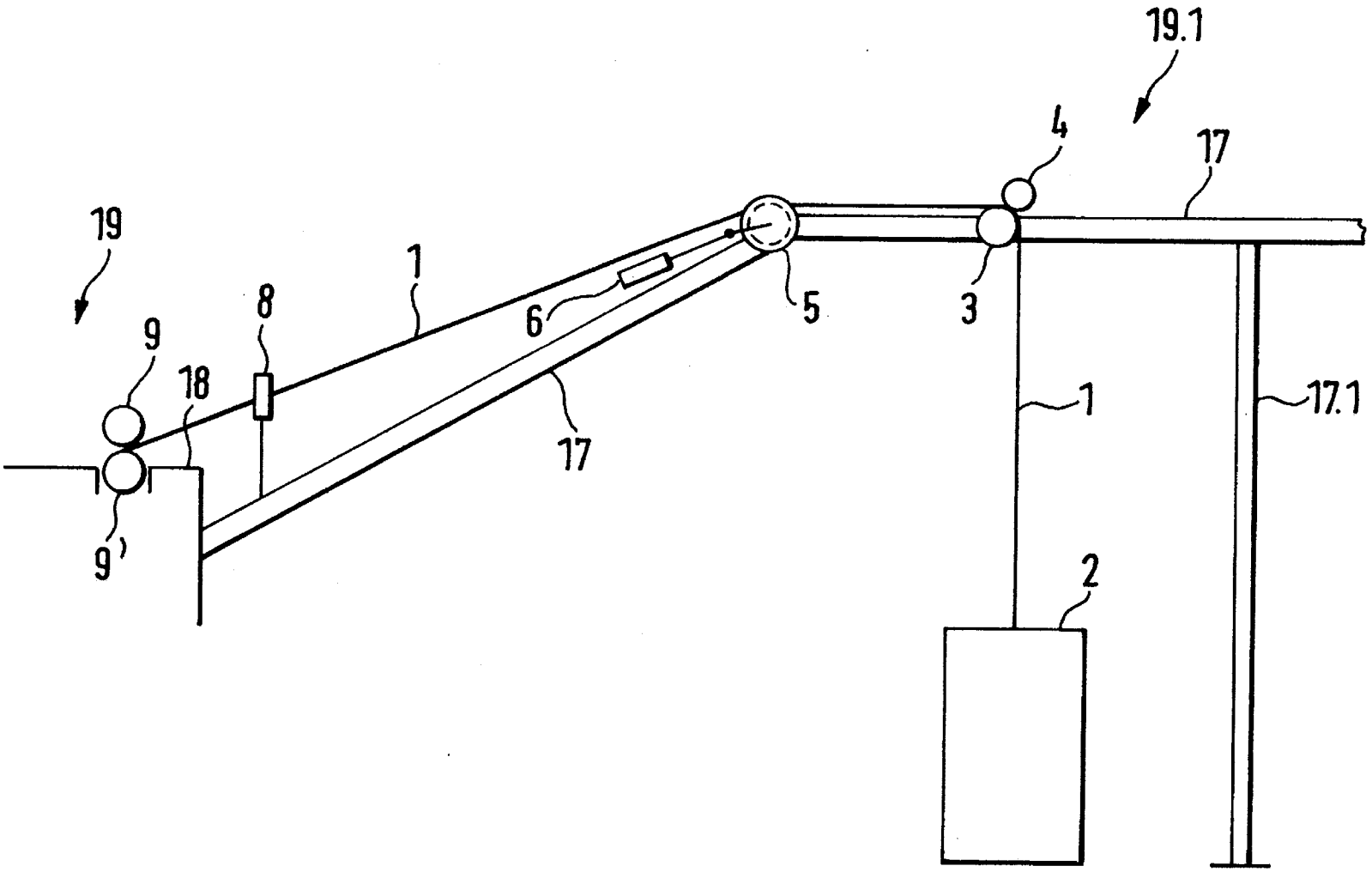
FIG. 1 is a schematic view of a known monitoring device between feeding device and draw frame.

Reference will now be made in detail to the presently preferred embodiments of the invention, one or more examples of which are illustrated in the drawings. Each example is provided by way of explanation of the invention, not limitation of the invention. The numbering of components is consistent throughout the description, with the same components having the same number.

FIG. 1 shows a detail of the intake of a draw frame 19. A pair of loading rollers 9, 9', the intake table 18, and a sliver guide 8 can be seen at the intake.

A feeding device 19.1 is located before the intake of draw frame 19. The feeding device consists of a frame 17 which is supported by pillars, such as pillar 17.1. Horizontal and rotatably mounted on the frame are a drive roller 3 and immediately on top of it a contact roller 4. The fiber sliver 1 is pulled out of can 2 between drive roller 3 and contact roller 4. The conveying path of the fiber sliver 1 continues to a sliver guiding roller 5 which is also mounted rotatably. Spacer rings are incorporated into the sliver guiding roller 5, so that a fiber sliver does not come into contact with the other fiber slivers.

A feeding device 19.1 can be designed in two different manners. Either as a roller feed, as of the type shown (FIG. 1), or as a feed frame. The difference is that the drive roller 3 and others are driven by the drive of the draw frame via a belt drive which is laid out in the frame 17. With the feeding frame these drive means are omitted.

The fiber sliver 1 leaves the feeding device 19.1 after passing the sliver guiding roller 5. The conveying path of the fiber sliver is now inclined in a sloped plane downward to the inlet of the draw frame 19. The fiber sliver 1 passes a sliver guide 8 in this process, which holds the slivers at predetermined distances from each other. The slivers run over the intake table 18 into the loading roller pair 9, 9'. From there it continues directly into the draw frame (as is not shown in the figure).

Figure 2:
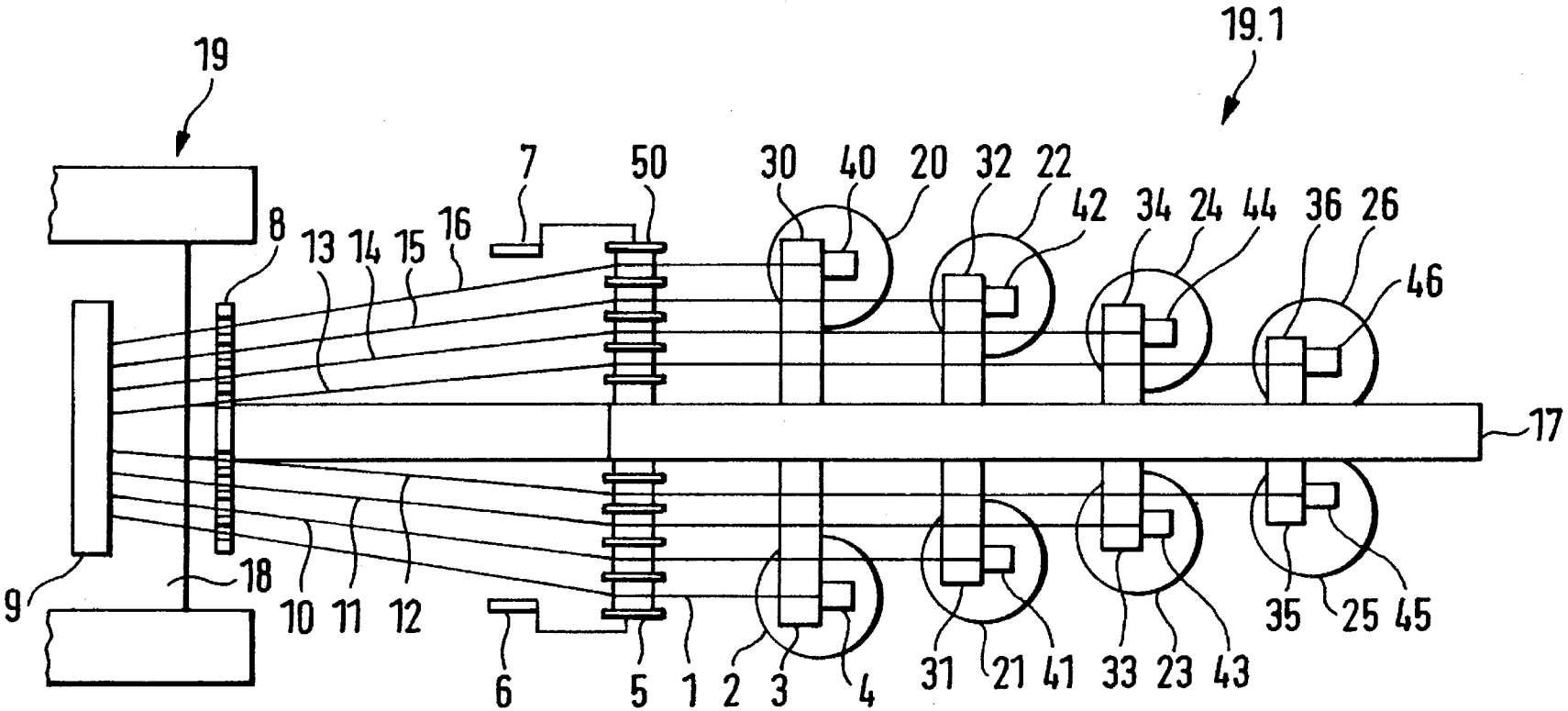
FIG. 2 is a top view for FIG. 1.

Along the path of the fiber sliver from the feeding device 19.1 to the intake of draw frame 19, near the sliver guiding roller 5, an optical emitter/receiver 6 is located. This is the monitoring device for the fiber slivers. The monitoring device has a monitoring section. The monitoring section functions on the optical light barrier principle. The monitoring section is placed at a right angle to the conveying paths of the fiber slivers and extends at a distance below the conveyor paths. The monitoring device may not be located too far from the intake of the draw frame, i.e. an arrangement in the central area of the feeding device 19.1 would not make sense because fiber sliver breaks would not be recognized after the monitoring device in the direction of the draw frame intake. On the other hand the monitoring device may not be installed too close to the intake of the draw frame 19, because otherwise the sliver end disappears between the roller pairs of the draw frame because of the high sliver intake speed, and could no longer be pieced with little effort to the other broken end. The monitoring device is therefore placed preferably before or after the sliver guiding roller, but in its immediate vicinity. Starting with FIG. 1 which shows the known state of the art, FIG. 2 shows the device of FIG. 1 in a top view for easier understanding. The feeding device 19.1 shown in FIG. 2 is a roller feeder in this specific case. Below the frame 17 the full cans 2, 20, 21, 22, 23, 24, 25, 26 can be recognized. Starting from these cans, the fiber sliver 1 is conveyed out of the can 2 between drive rollers 3 and contact roller 4. In the case of fiber sliver 10, these are drive roller 31 and contact roller 41. With fiber sliver 11 it is the drive roller 33 and the contact roller 43 and with fiber sliver 12 it is the drive roller 35 and contact roller 45. On the opposite side of the frame 17, the fiber sliver 16 is taken from the can 20 and is located between drive roller 30 and contact roller 40. The fiber sliver 15 is taken from the can 22 and is located between drive roller 32 and contact roller 42. Fiber sliver 14 is taken from can 24 and is located between drive roller 34 and contact roller 44. The fiber sliver 13 is taken from can 26 and is located between drive roller 36 and contact roller 46.

These fiber slivers are conveyed parallel to each other and in one plane to the feeding device 19.1. The fiber slivers are conveyed from the drive rollers to the sliver guiding rollers 5, 50. The sliver guiding rollers are provided with spacer rings so that a fiber sliver cannot come into contact with another sliver. The fiber slivers leave the feeding device 19.1 and reach the intake of the draw frame 19. There they pass the sliver guide 8 and are seized by the loading roller pair 9, 9'. FIG. 2 shows furthermore that the monitoring device consists of an optical emitter/receiver 6 as well as of the appertaining optical reflector 7. These are placed in one plane with respect to each other and are located between fiber slivers and frame 17. The optical emitter/receiver 6 constantly emits a light ray which is reflected back to the receiver by the reflector 7. This is the monitoring section. When this light path (light barrier) is interrupted, the draw frame is stopped, i.e. the intake of fiber slivers also comes to a stop.

Because of the relatively low weight of fiber slivers and the very high sliver intake speeds, sliver breakage could not be detected with certainty in the past. Often broken fiber sliver ends reached the drop level necessary to interrupt the monitoring section (light barrier) only after the monitoring device.

Figure 3:
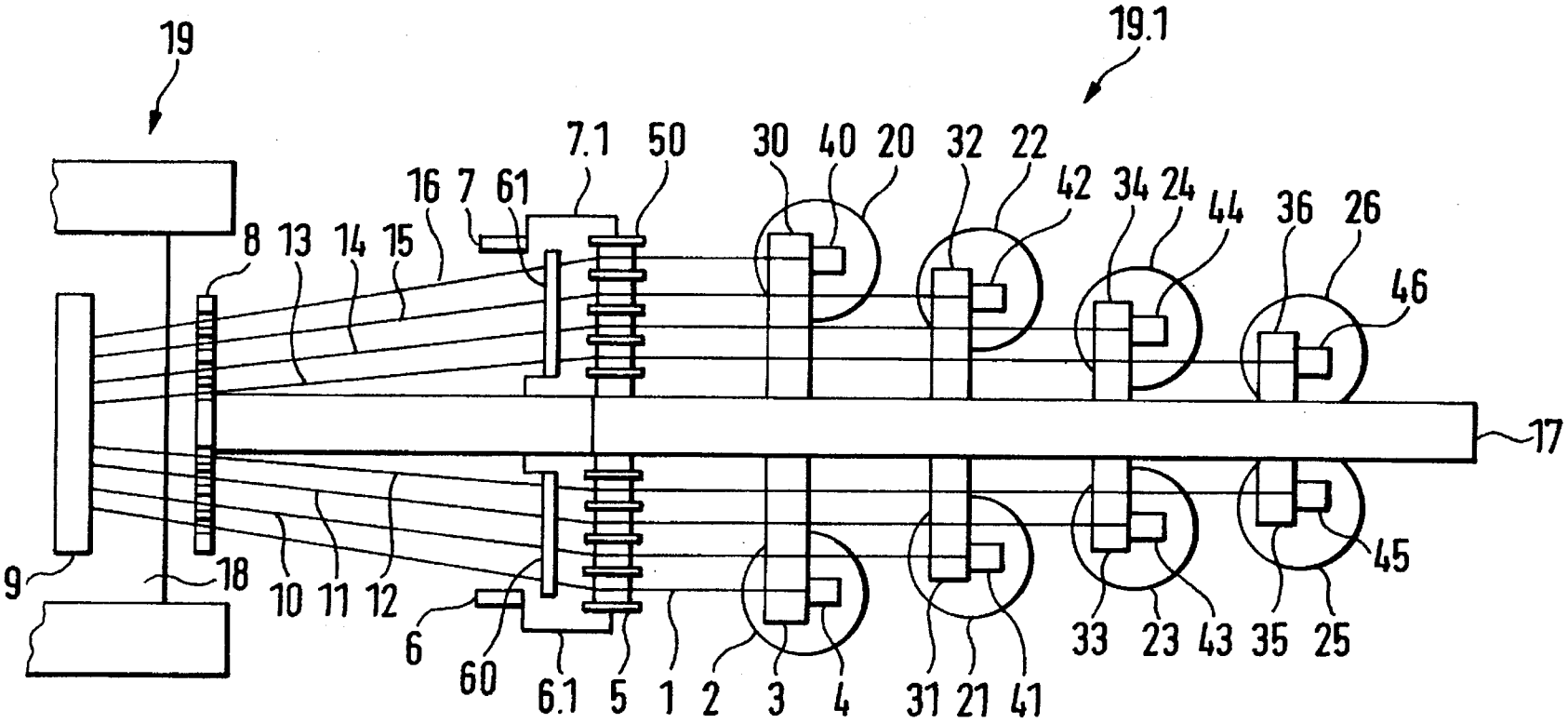
FIG. 3 shows a monitoring device with deflection bar in a top view.

FIG. 3 shows the arrangement of a monitoring device between feeding device and draw frame. In the present instance the feeding device is shown in detail as a roller feeder.

Figure 4:
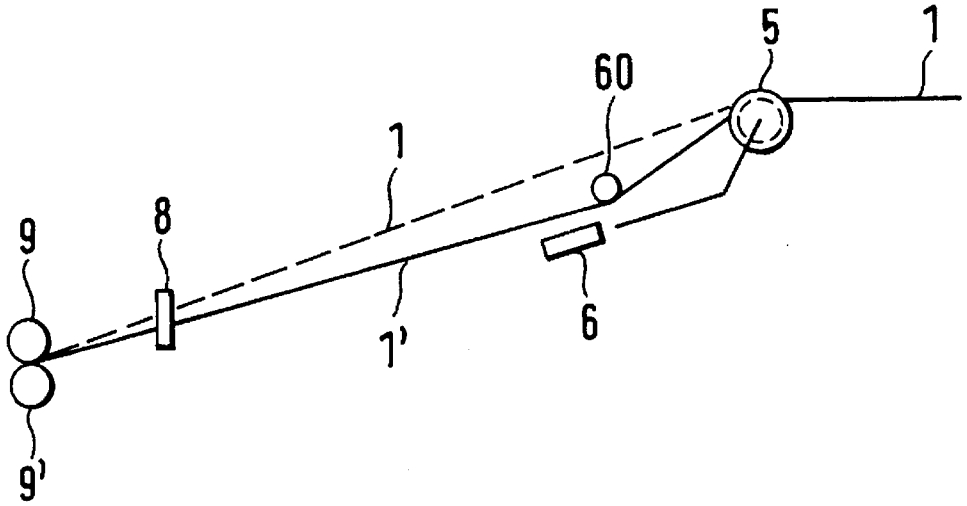
FIG. 4 shows the pre-stress of the fiber sliver produced by the deflection bar before the monitoring device, with the monitoring device being located between feeding device and draw frame.

FIG. 3 shows in detail the utilization of a deflection device according to the invention in proximity of the monitoring device. A deflection bar 60 or 61 with circular or elliptic cross-section was used as the deflection device. It is also possible to use a pipe. Low-friction material is used. The monitoring device consisting of optical emitter/receiver 6 and optical reflector 7 is therefore installed in combination with the deflection bars 60, 61. The deflection bars are at a right angle to the conveying path of the fiber slivers before the monitoring device, i.e. the fiber slivers pass the deflection bars before coming into proximity of the monitoring device. As FIG. 4 shows specifically for fiber sliver 1, the deflection bar 60 deflects the fiber sliver 1 from its original position to fiber sliver 1'. This deflection is simultaneous for all fiber slivers. Through this deflection, the fiber slivers are pre-stressed. This pre-stress is relatively low, but sufficient in order to throw the fiber sliver end downward as a result of pre-stress when a sliver breakage occurs, so that it is certain to be able to briefly interrupt the monitoring section (optical light barrier) of the monitoring device.

It is possible to install the deflection bar not only as shown in FIG. 3, before the monitoring device, but also in proximity after the monitoring device. This is a further characteristic of the invention.

The electrical transmission paths from the light barrier to the evaluation unit are not shown since they are generally known. Optical emitter/receiver 6 as well as reflector 7 are attached by their mounts 6.1 and 7.1 rigidly to the axle of the sliver guiding rollers 5, 50.

Figure 5:
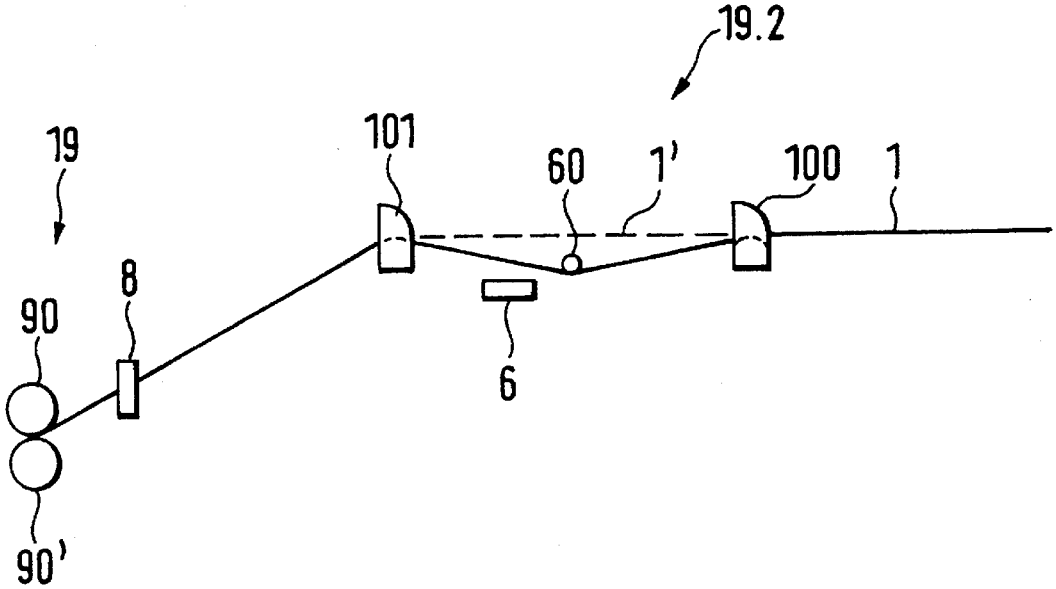
FIG. 5 shows the monitoring device with deflection device in the feeding frame.

FIG. 5 shows a detail of a feeding device which is made in form of a feeding frame 19.2. The monitoring device is placed inside and at the end of the feeding frame.

With a feeding frame 19.2 the monitoring device with the deflection bar can also be placed before the sliver guides 100, 101.

It will be apparent to those skilled in the art that various modifications and variations can be made in the present invention without departing from the scope or spirit of the invention. For example, features of one embodiment can be used on another embodiment to yield a still further embodiment. it is intended that the present invention cover such modifications and variations as come within the scope of the appended claims and their equivalents.

I claim:

1. A device for detecting breakage of fiber slivers delivered to a draw frame in a running direction along a running path by a feeding device, said device comprising a monitoring device defining a monitoring section defined below the running path of fiber slivers to said draw frame, said device further comprising a deflection device disposed so as to contact and deflect the fiber slivers from a straight path in their running path to said draw frame towards said monitoring section, said deflection device imparting a pre-stress to said fiber slivers so that when any individual fiber sliver breaks said pre-stress condition ensures that said broken sliver falls through said monitoring section.

2. The device as in claim 1, wherein said deflection device is disposed before said monitoring device in the running direction of the fiber slivers to said draw frame.

3. The device as in claim 1, wherein said deflection device is disposed after said monitoring device in the running direction of the fiber slivers to said draw frame.

4. The device as in claim 1, wherein said deflection device is disposed in a horizontal plane located above a horizontal plane defined by said monitoring section so that unbroken fiber slivers pass above said monitoring section in their normal path to said draw frame.

5. The device as in claim 4, wherein said deflection device contacts and presses the fiber slivers towards said monitoring section.

6. The device as in claim 5, wherein said deflection device is disposed so that the fiber slivers run between said deflection device and said monitoring section in their running path to said draw frame.

7. The device as in claim 1, wherein said deflection device comprises a bar disposed transverse to the normal running path of the fiber slivers to said draw frame.

8. The device as in claim 7, wherein said bar comprises a tubular element.

9. The device as in claim 7, wherein said bar is disposed at a right angle to the normal running path of the fiber slivers.

10. The device as in claim 7, wherein said bar comprises a low-friction material surface which contacts the fiber slivers in their normal running path to said draw frame.

11. A draw frame configured for drawing a plurality of fiber slivers, said draw frame comprising:

a feeding device, said feeding device including feed driving devices for withdrawing the fiber slivers from storage cans;

a guiding roller configured to receive the plurality of fiber slivers from said feed driving devices;

a sliver guide configured to receive the plurality of fiber slivers from said guiding roller;

a pair of loading rollers configured to receive the plurality of fiber slivers from said sliver guide, the fiber slivers moving in a running direction along a running path from said feeding device, through said sliver guide to said loading rollers; and a monitoring device defining a monitoring section, said monitoring section being defined below the running path of fiber slivers to said draw frame, said device further comprising a deflection device disposed so as to contact and deflect the fiber slivers in their running path from a straight path from said guiding rollers to said draw frame, said deflection device imparting a pre-stress to said fiber slivers so that when any individual fiber sliver breaks said pre-stress condition ensures that said broken sliver falls through said monitoring section.

12. The draw frame as in claim 11, wherein said deflection device is disposed before said monitoring device in the running direction of the fiber slivers to said draw frame.

13. The draw frame as in claim 11, wherein said deflection device is disposed after said monitoring device in the running direction of the fiber slivers to said draw frame.

14. The draw frame as in claim 11, wherein said deflection device is disposed in a horizontal plane located above a horizontal plane defined by said monitoring section so that unbroken fiber slivers pass above said monitoring section in their normal running path to said draw frame.

15. The draw frame as in claim 14, wherein said deflection device contacts as presses the fiber slivers towards said monitoring section.

16. The draw frame as in claim 15, wherein said deflection device is disposed so that the fiber slivers run between said deflection device and said monitoring section in their normal running path to said draw frame.

17. The draw frame as in claim 11, wherein said deflection device comprises a bar disposed transverse to the normal running path of the fiber slivers to said draw frame.

18. The device as in claim 17, wherein said bar comprises a tubular element.

19. The device as in claim 17, wherein said bar is disposed at a right angle to the normal running path of the fiber slivers.

20. The device as in claim 17, wherein said bar comprises a low-friction material surface which contacts the fiber slivers in their normal running path to said draw frame.

* * * * *